United States Patent [19]

Mukai et al.

[11] Patent Number: 4,656,790

[45] Date of Patent: Apr. 14, 1987

[54] BURNISHING METHOD AND APPARATUS FOR MAGNETIC DISK

[75] Inventors: Kazuo Mukai; Akira Honjoh, both of Tokyo; Shuji Nakata, Kanagawa, all of Japan

[73] Assignee: Fuji Photo Film Co., Ltd., Kanagawa, Japan

[21] Appl. No.: 801,762

[22] Filed: Nov. 26, 1985

[30] Foreign Application Priority Data

Dec. 4, 1984 [JP] Japan ..... 59-256290

[51] Int. Cl.[4] ..... B24B 21/00

[52] U.S. Cl. ..... 51/141; 51/145 R

[58] Field of Search ..... 51/145 R, 141, 148, 51/135

[56] References Cited

U.S. PATENT DOCUMENTS 3,283,447 11/1966 Cretsinger ..... 51/141

4,535,567 8/1985 Seaborn ..... 51/145 R

*Primary Examiner*—Frederick R. Schmidt

*Assistant Examiner*—Maurina Rachuba

*Attorney, Agent, or Firm*—Gerald J. Ferguson, Jr.; Michael P. Hoffman; Ronni S. Malamud

[57] ABSTRACT

A magnetic disk is rotated by a drive mechanism, and compressed air is jetted to the same positions on the two surfaces of the magnetic disk. An abrasive tape and a magnetic material surface of the magnetic disk are made to contact each other closely by compressed air, and the magnetic material surface of the magnetic disk is burnished by the abrasive tape.

4 Claims, 3 Drawing Figures

BURNISHING METHOD AND APPARATUS FOR MAGNETIC DISK

BACKGROUND OF THE INVENTION

1. Field of the Invention

This invention relates to a method of burnishing a magnetic material surface of a magnetic disk (flexible disk) by an abrasive tape, and an apparatus for carrying out the method.

2. Description of the Prior Art

In the conventional method of burnishing a surface of a magnetic disk by an abrasive tape, the surface of the magnetic disk is smoothed by supporting the magnetic disk on a rotatable substrate and pushing the abrasive surface of the abrasive tape against the magnetic material surface of the magnetic disk to remove surplus protrusions of the magnetic material.

In the conventional method, the whole magnetic disk is supported by the rotatable substrate, and the abrasive tape is backed by a backing roll fabricated of metal, rubber, or the like or by a pushing rod made of felt or the like and pushed against the surface of the magnetic disk.

However, in the conventional method, debris generated by abrasion by the abrasive tape, dust in the ambient air, or foreign matter sticking to the rear surface of the abrasive tape during fabrication of the abrasive tape enters between the abrasive tape and the backing roll or the pushing rod, and generates abrasion streaks on the burnished magnetic disk surface. Also, there is the risk of defects such as abrasion streaks arising on the burnished surface from the adverse effects of foreign matter or protrusions and recesses intervening between the rotatable substrate and the magnetic disk opposite to the burnished surface of the magnetic disk.

SUMMARY OF THE INVENTION

The primary object of the present invention is to provide a method of uniformly burnishing the magnetic material surface of a magnetic disk without generating defects such as abrasion streaks.

Another object of the present invention is to provide an apparatus for carrying out the method.

The present invention provides a method of burnishing a surface of a magnetic disk by use of an abrasive tape, which comprises the steps of: rotating said magnetic disk, jetting compressed air to the same positions on the two surfaces of said magnetic disk, and closely contacting said abrasive tape with the magnetic material surface of said magnetic disk, thereby conducting the burnishing.

The burnishing method of the present invention is carried out by an apparatus comprising a drive mechanism for supporting and rotating a magnetic disk, air nozzles positioned on each surface side of said magnetic disk so that they face each other for jetting compressed air to said magnetic disk, and an abrasive tape intervening between one of said air nozzles and a magnetic material surface of said magnetic disk.

In the burnishing method of the present invention, since the magnetic disk and the abrasive tape are pushed against each other by compressed air and the magnetic disk is rotated to burnish the magnetic material surface of the magnetic disk, debris generating by abrasion is blown off by compressed air. Also, since no other member contacts the magnetic disk or the abrasive tape to push the magnetic disk and the abrasive tape against each other, burnishing is not adversely affected by non-uniformity of magnetic material coating or the like, and it is possible to obtain a uniformly burnished surface without abrasion streaks or the like. Further, it is easy to adjust the contact area and pushing force between the magnetic disk and the abrasive tape, and it becomes possible to improve the processing efficiency.

In the burnishing apparatus of the present invention, it is possible to carry out the burnishing method easily, and burnishing of the magnetic disk is achieved with high efficiency.

DESCRIPTION OF THE PREFERRED EMBODIMENTS

The present invention will hereinbelow be described in further detail with reference to the accompanying drawings.

Figure 1:
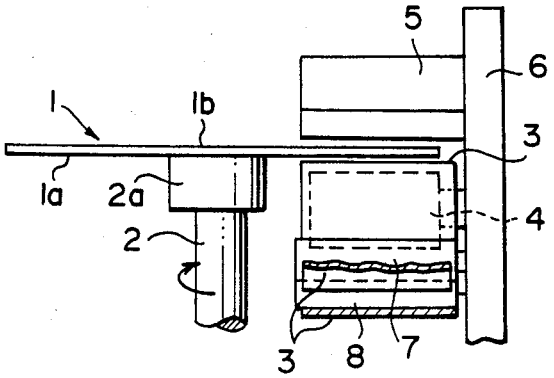
FIG. 1 is a front view showing an embodiment of the burnishing apparatus in accordance with the present invention.
Figure 3:
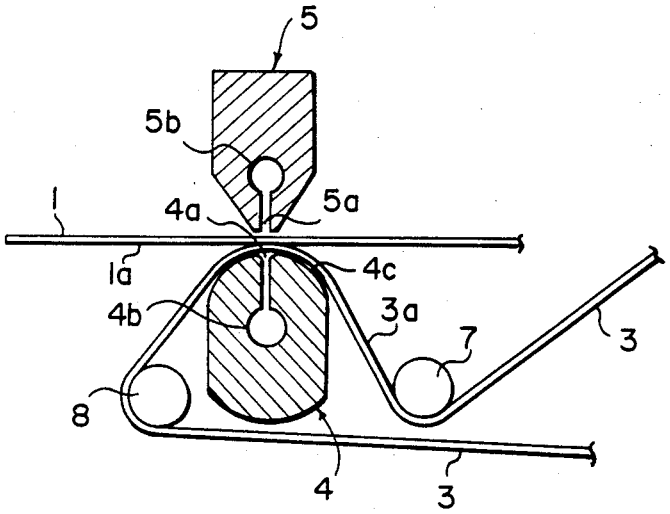
FIG. 3 is a sectional view showing the nozzle section of the burnishing apparatus of FIG. 1.
Figure 2:
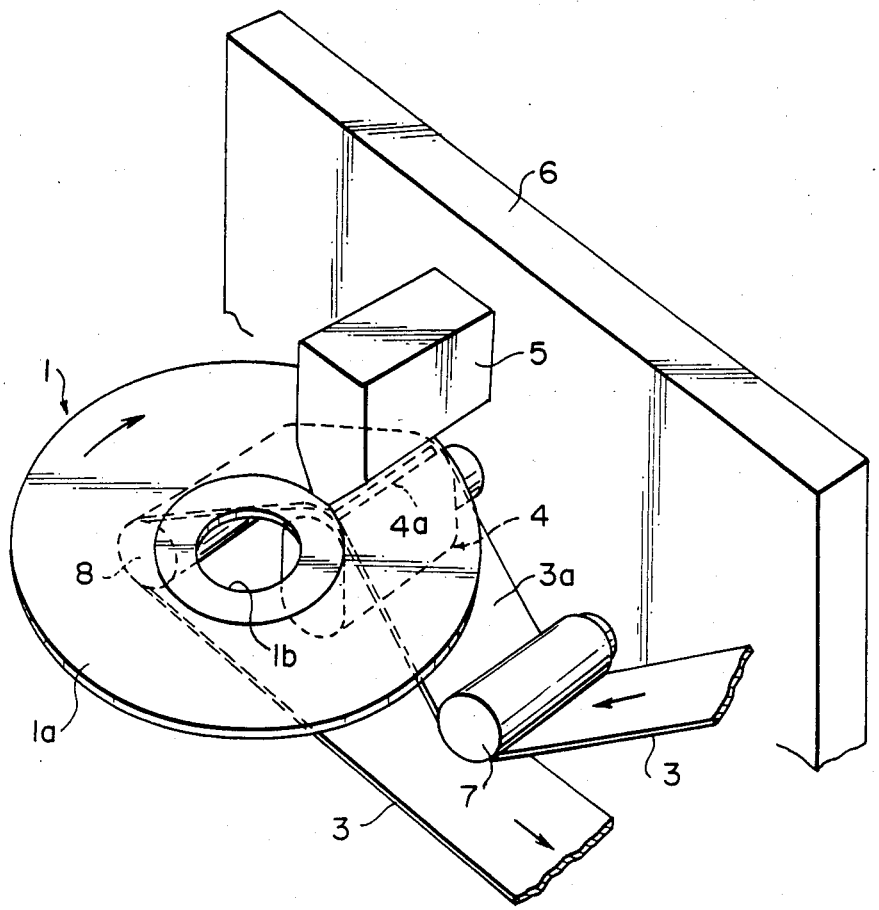
FIG. 2 is a perspective view showing the burnishing apparatus of FIG. 1 by omitting the drive mechanism.

FIG. 1 is a front view showing an embodiment of the burnishing apparatus in accordance with the present invention, FIG. 2 is a perspective view showing the burnishing apparatus by omitting the drive mechanism, and FIG. 3 is a sectional view showing the nozzle section.

An inner circumferential portion 1*b* inside of a recording and reproducing portion 1*a*, i.e. the magnetic material surface which should be burnished, of a magnetic disk (flexible disk) 1 is held by a vacuum chuck 2*a* at an end of a rotation shaft 2. The rotation shaft 2 is rotated by a drive mechanism (not shown), and the magnetic disk 1 is rotated, for example, at a speed within the range of 1,000 rpm to 3,000 rpm.

The magnetic material surface 1*a* of the magnetic disk 1 is burnished by being made to contact closely an abrasive surface 3*a* of an abrasive tape 3. Close contact of the magnetic disk 1 with the abrasive tape 3 is achieved by compressed air jetted from air nozzles 4 and 5 facing each other.

Specifically, a first air nozzle 4 for backing the abrasive tape 3 is positioned on the lower surface side of the magnetic disk 1. An air jetting port 4*a* of the first air nozzle 4 is positioned close to the magnetic material surface 1*a* of the magnetic disk 1 which is to be burnished. The abrasive tape 3 intervenes between the air jetting port 4*a* and the magnetic disk 1. A second air nozzle 5 for taking the burnishing pressure exerted by the abrasive tape 3 on the magnetic disk 1 is positioned on the upper surface side of the magnetic disk 1 to face the first air nozzle 4. An air jetting port 5*a* of the second air nozzle 5 is positioned close to the surface of the magnetic disk 1 on the side opposite to the side which contacts the abrasive tape 3. An end surface 4*c* of the first air nozzle 4 is formed in a curved shape to adapt to the movement of the abrasive tape 3.

The first air nozzle 4 and the second air nozzle 5 are spaced at a predetermined distance from each other and secured to a substrate 6. Compressed air of a predetermined pressure is introduced into the passages 4*b* and 5*b* in the air nozzles 4 and 5 via the substrate 6, and communicated from the passages 4*b* and 5*b* respectively to the slit-like air jetting ports 4*a* and 5*a*. The pressure of the compressed air supplied to the first air nozzle 4 and the second air nozzle 5 may be varied, for example, up to 6kg/cm$^2$ or less. By adjusting the pressure of the compressed air, it is possible to change the contact pressure between the abrasive tape 3 and the magnetic disk 1 and to adjust the burnishing depth. When the pressure of the compressed air fed to the first air nozzle 4 is within the range of approximately 1.0 to 2.5kg/cm$^2$, the pressure of the compressed air fed to the second air nozzle 5 should preferably be adjusted to a value within the range of approximately 1.5 to 4.0kg/cm$^2$.

The abrasive tape 3 is passed around guide rollers 7 and 8 positioned one on either side of the first air nozzle 4 so that the abrasive tape 3 runs from the guide roller 7 to the end surface 4*c* of the first air nozzle 4 and is then curved around the guide roller 8. The abrasive tape 3 is intermittently fed by a feed mechanism (not shown) to run reversely to the rotating direction of the magnetic disk 1. The running speed of the abrasive tape 3 is, for example, approximately 7 mm/sec. Abrasive particles of the abrasive surface 3*a* of the abrasive tape 3 may, for example, be chrome oxide, silicon carbide, iron oxide, alumina, or diamond particles.

While the magnetic disk 1 is rotated at high speeds by the drive mechanism, compressed air of a predetermined pressure is blown from the first air nozzle 4 and the second air nozzle 5 at the abrasive tape 3 and the magnetic disk 1. In this manner, the abrasive tape 3 and the magnetic material surface 1*a* of the magnetic disk 1 are made to contact each other at a predetermined contact pressure, and burnishing is conducted for a period within the range of, for example, 0.5 to 1.0 sec.

In the aforesaid embodiment, burnishing is conducted by moving the abrasive tape 3 reversely to the rotating direction of the magnetic disk 1. However, it is also possible to move the abrasive tape 3 in the same direction as the rotating direction of the magnetic disk 1. Or, the abrasive tape 3 may be maintained motionless for the burnishing and the abrasive tape 3 moved after completion of each burnishing is finished.

Further, burnishing of the magnetic disk 1 may also be conducted from above the disk, or the upper and lower surfaces of the magnetic disk 1 may be simultaneously burnished. In this case, an additional set of first and second air nozzles and the mechanism for feeding the abrasive tape 3 will be added.

When burnishing of the magnetic disk is conducted as described above, particles of the magnetic material released by the abrasive tape are blown off by the compressed air jetted from the first or second air nozzle. Therefore, the particles of the magnetic material do not cause abrasion streaks by intervening at the contact point between the abrasive tape and the magnetic disk. Also, since the surface of the magnetic disk which should be burnished and the opposite surface thereof are supported at a uniform pressure by compressed air, burnishing is not adversely affected by minute protrusions and recesses of the magnetic material on the opposite surface of the magnetic disk, and it is possible to achieve uniform burnishing.

We claim:

1. A method of burnishing a surface of a magnetic disk by use of an abrasive tape, which comprises the steps of: rotating said magnetic disk, jetting compressed air via opposed air nozzles to the same positions on the two surfaces of said magnetic disk, intervening said abrasive tape between one of said air nozzels and one of said surfaces of said magnetic disk, and closely contacting said abrasive tape with the magnetic material surface of said magnetic disk and thereby conducting the burnishing.

2. A method as defined in claim 1 wherein said abrasive tape is moved reversely to the rotating direction of said magnetic disk.

3. An apparatus for burnishing a surface of a magnetic disk, which comprises a drive mechanism for supporting and rotating a magnetic disk, air nozzles positioned on each surface side of said magnetic disk so that they oppose each other for jetting compressed air at said magnetic disk, and an abrasive tape intervening between one of said air nozzles and a magnetic material surface of said magnetic disk.

4. An apparatus as defined in claim 3 wherein air jetting ports of said air nozzles extend approximately from the inner edge portion to the outer edge portion of the recording area of said magnetic disk.

* * * * *

REEXAMINATION CERTIFICATE (990th)

United States Patent [19]

[11] B1 4,656,790

Mukai et al.

[45] Certificate Issued Jan. 10, 1989

[54] BURNISHING METHOD AND APPARATUS FOR MAGNETIC DISK

[75] Inventors: Kazuo Mukai; Akira Honjoh, both of Tokyo; Shuji Nakata, Kanagawa, all of Japan

[73] Assignee: Fuji Photo Film Co., Ltd., Kanagawa, Japan

Reexamination Request:
No. 90/001,433, Jan. 29, 1988

Reexamination Certificate for:

| | |
|---|---|
| Patent No.: | **4,656,790** |
| Issued: | **Apr. 14, 1987** |
| Appl. No.: | **801,762** |
| Filed: | **Nov. 26, 1985** |

[30] Foreign Application Priority Data

Dec. 4, 1984 [JP] Japan ..... 59-256290

[51] Int. Cl.[4] ..... B24B 21/00

[52] U.S. Cl. ..... 51/141; 51/145 R

[58] Field of Search ..... 51/135, 141, 145 R, 51/148, 154, 281 SF, 324, 328; 427/130

[56] References Cited

U.S. PATENT DOCUMENTS 4,535,567 8/1985 Seaborn ..... 51/140

FOREIGN PATENT DOCUMENTS 59-110546 6/1984 Japan .

*Primary Examiner*—Robert P. Olszewski

[57] ABSTRACT

A magnetic disk is rotated by a drive mechanism, and compressed air is jetted to the same positions on the two surfaces of the magnetic disk. An abrasive tape and a magnetic material surface of the magnetic disk are made to contact each other closely by compressed air, and the magnetic material surface of the magnetic disk is burnished by the abrasive tape.

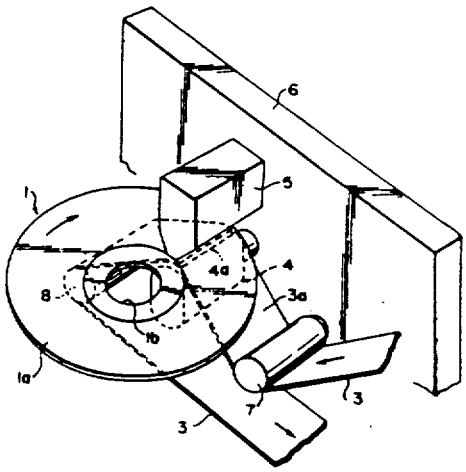

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 3 are determined to be patentable as amended.

Claims 2 and 4, dependent on an amended claim, are determined to be patentable.

1. A method of burnishing a surface of a magnetic disk by use of an abrasive tape, which comprises the steps of: rotating said magnetic disk, jetting compressed air via [opposed air nozzles to the same positions on the two surfaces] *a first air nozzle directly against one surface of the magnetic disk and via a second air nozzle on the*

*opposite side of the disk toward a corresponding position on the opposite side surface* of said magnetic disk, intervening said abrasive tape between [one of said air nozzles] *the second air nozzle* and *the opposite* one of said surfaces of said magnetic disk, and closely contacting said abrasive tape with the [magnetic material] *opposite side* surface of said magnetic disk and thereby conducting the burnishing *under controlled contact pressure condition, the second air nozzle providing an unimpeded air flow from the nozzle to the abrasive tape.*

3. An apparatus for burnishing a surface of a magnetic disk, which comprises a drive mechanism for supporting and rotating a magnetic disk, [air nozzles positioned on each] *a first air nozzle positioned on a first* surface side of said magnetic disk [so that they oppose each other] for jetting compressed air *directly* at said *first surface side of the* magnetic disk, *a second air nozzle positioned on the opposite side of the magnetic disk for jetting compressed air toward a position on the opposite side surface of the disk corresponding to the position of impingement of air from the first nozzle on the first side surface of the disk* and an abrasive tape intervening between [one of said air nozzles] *the second air nozzle* and [a magnetic material] *the opposite side* surface of said magnetic disk, *the second air nozzle providing an unimpeded air flow from the nozzle to the abrasive tape.*

* * * * *